United States Patent [19]

D'Agostino

[11] 3,992,966

[45] Nov. 23, 1976

[54] PUNCH ASSEMBLY FOR FILM PRODUCTS WITH WORK CLAMPING MEANS

[75] Inventor: Salvatore Patrick D'Agostino, Deer Park, N.Y.

[73] Assignee: Sheldahl, Inc., Northfield, Minn.

[22] Filed: Feb. 18, 1975

[21] Appl. No.: 550,202

[52] U.S. Cl. ..... 83/175; 83/282; 83/375; 83/386; 83/389; 83/456; 83/460

[51] Int. Cl.[2] ..... B26D 7/14

[58] Field of Search ..... 83/175, 282, 375, 386, 83/389, 456, 460, 98, 124, 140

[56] References Cited

UNITED STATES PATENTS

| | | | |
|---|---|---|---|
| 2,376,829 | 5/1945 | Sokolowsky | 83/140 |
| 2,432,804 | 12/1947 | Rieske | 83/375 |
| 2,561,050 | 7/1951 | Charron | 83/98 |
| 3,501,985 | 3/1970 | Baran | 83/140 |

*Primary Examiner*—Donald R. Schran
*Attorney, Agent, or Firm*—Orrin M. Haugen

[57] ABSTRACT

Punching apparatus particularly adapted for use in connection with flexible film materials including cooperatively arranged punch and die assemblies arranged in aligned relationship, and ram means for reciprocably driving or stroking the punch assembly in a reciprocatory path into engagement with the work film and die for performing cutting or perforating operations on the film. A film clamping shoe is provided on the punch and is disposed in opposed relationship to the die assembly, the shoe being arranged to clampably engage the work film disposed between the punch and the die upon advancing or stroking motion of the punch. An annular flange extends upwardly from the surface of the die and toward the punch and film clamping shoe means so as to provide for taut engagement and retension of the film by the film clamping shoe means.

7 Claims, 4 Drawing Figures

PUNCH ASSEMBLY FOR FILM PRODUCTS WITH WORK CLAMPING MEANS

BACKGROUND OF THE INVENTION

The present invention relates generally to an improved reciprocating punching mechanism, and more particularly to a high-speed reciprocating punch device especially adapted for use in connection with thin flexible film materials. The punching mechanism is adapted to handle multi-ply films wherein the cumulative thickness becomes substantial. The punch apparatus includes relatively movable punch and die assemblies, the punch assembly having a cutter adapted to pass through the surface of the film and the plane of the die so as to form openings, holes or slots within the film material passing through the working zone between the punch and die. Clamping shoe means are provided for retaining the flexible film material in taut disposition during punching, and in addition, means are provided for ejecting or removing the slug of film material which is obtained or formed upon a punching operation or event.

In the forming of holes or slotted openings in thin film materials, it is extremely important that the location of the holes be accurately positioned. Furthermore, products frequently demand the formation of clean, non-scalloped openings or bores in the film, and ragged or scalloped surfaces are accordingly undesirable and may contribute to the generation of scrap. Furthermore, film materials may be abrasive and cause considerable wear on punching equipment, and the extent of wear or lack of sharpness of the cutting tool becomes a less critical factor when the clamping apparatus of the present invention is being employed on the film.

SUMMARY OF THE INVENTION

Briefly, in accordance with the present invention, a punch for film materials is provided with a punch member adapted to reciprocate between a normal disposition and an extended disposition, with the motion being along a linear path of a certain predetermined length. The punch is provided with a cutting surface which engages the film while the punch is moving from its normal disposition to its extended disposition for the purpose of performing an operation on the film. The film is adapted to move as a web through a plane in the jaw zone separating the punch and the die, with the film moving intermittently so as to have alternate periods of draw and dwell, with the periods of dwell existing, of course, between intermittent periods of motion. While the film is at dwell, the punch is moved reciprocatorily into contact with the film and the die and the punching operation is accordingly accomplished. Ram means are provided to stroke or drive the punch, with such means typically being a cylinder driven with compressed air, with the compressed air being timely pulsed, as required.

In order to retain the flexible film in taut disposition on the die during the punching operation, a clamping shoe is provided which is slidably secured to the punch and adapted to move with the punching member during stroking thereof. The clamping shoe is further arranged to engage the film prior to the punch reaching its bottom dead-center position, thereby clamping the film against the surface of the die or die base; thus securing the film in taut disposition at the point in time when the cutting surfaces of the punch engage the surface of the film. A raised annular flange is provided about the surface of the die base surrounding the die bore or opening so as to increase the tautness of that portion of the film held above the die bore and within, about and through the area to be served or cut, thereby forming a clean cut in the film which is free of scalloping and other surface irregularities.

It is therefore a primary object of the present invention to provide an improved clamping means for use in connection with a punch assembly for the perforation of flexible film products, the clamping arrangement being utilized to engage the film and retain the portion to be cut in taut form during the time that the cutting surfaces of the punch engage the surface of the film during the punching or cutting operation.

It is yet a further object of the present invention to provide an improved punching mechanism with cooperatively arranged punch and die assemblies, the punch mechanism including a film clamping shoe means which is adapted to tautly engage and retain the flexible film during the cutting operation, with the film tension being increased in the area or zone immediately surrounding the cut.

Other and further objects of the present invention will become apparent to those skilled in the art upon a study of the following specification, appended claims, and accompanying drawings.

DESCRIPTION OF THE PREFERRED EMBODIMENT

Figure 1:
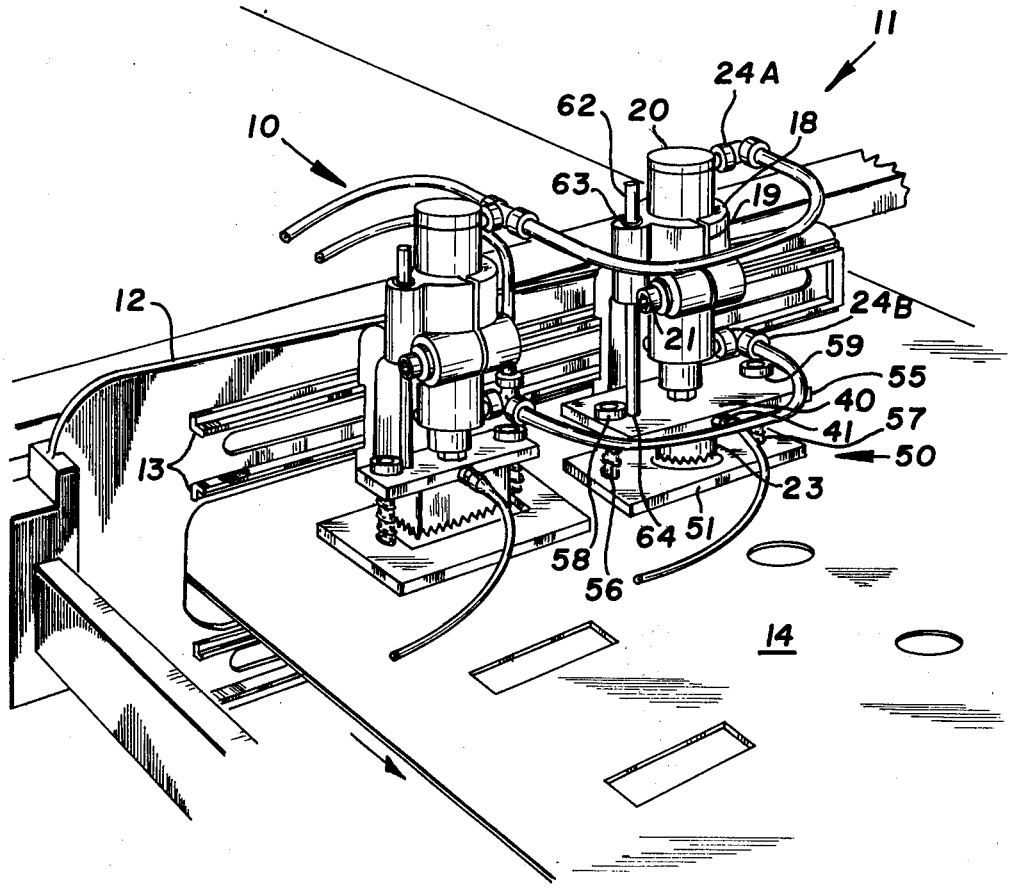
FIG. 1 is a front perspective view of a pair of punch assemblies arranged on a transversely extending bracket, the punches being shown with a web of flexible film material being moved between the punch and die.

In accordance with the preferred modification of the present invention, and with particular attention being directed to FIG. 1 of the drawings, there is shown first and second punch assemblies generally designated 10 and 11, these punch assemblies being mounted on a transversely extending frame or bracket 12. Means are provided for adjusting the lateral positioning of punches 10 and 11 along the bracket 12, these means including for example, the provision of mounting rails such as are shown, for example, at 13. The work web of film material is shown generally at 14, and, as indicated, passes beneath the individual punches 10 and 11. With attention being directed temporarily to FIG. 2 of the drawings, a cooperating die assembly shown generally at 16 is provided and disposed immediately below the surface of the film 14, the operation of the punch and die being made manifest hereinafter.

With the exception of the actual configuration of the punch and die assemblies, the punches 10 and 11 are substantially identical, one to another, and hence this description will relate the details only of the punch 11, it being understood that the details of construction of punch 10 are generally identical to those of punch 11. Each punch includes a mounting head 18, the head having a support sleeve configuration as at 19 so as to adjustably retain the punch drive cylinder 20 therewithin. In other words, the drive cylinder 20 is received within the confines of the split head 18, and may be disposed at any preferred elevation relative to the surface of the film 14, adjustable clamping screw being provided at 21 to accomplish this purpose. The punch is provided with a rod, ram or shank portion 22, the punching head 23 with its die engaging surface or face being secured to the forward end thereof, the ram 22 and die engaging face of punch 23 being adapted to move reciprocably within or through a bore formed in the die, with motion being provided by drive cylinder 20 and shown in detail in FIG. 2. While conventional drive and control systems may be utilized for this punch assembly, a specific actuating valve and cylinder control system is disclosed in detail in co-pending application filed concurrently herewith and entitled "PUNCH FOR FILM PRODUCTS HAVING IMPROVED SLUG REMOVAL FACILITY", William S. Coombes now U.S. Pat. No. 3,939,743, and assigned to the same assignee as the present invention, this actuating system having means to transmit fluid under pressure to the upper cylinder port 24A for driving the punching head downwardly, while port 24B is adapted to receive fluid under pressure for returning and retaining the punch to its elevated or normal disposition. Thus, drive cylinder 20 is a dual acting air cylinder having a piston 30 operating within the housing or sleeve 31 and being secured to the top or inner end of the ram 22, as at 32. Suitable guide means and bushings are provided along with an O-ring seal 39, O-ring 39 preventing leakage of compressed fluid around the moving shank or ram portion 22 as is conventional in this type of drive system.

Figure 2:
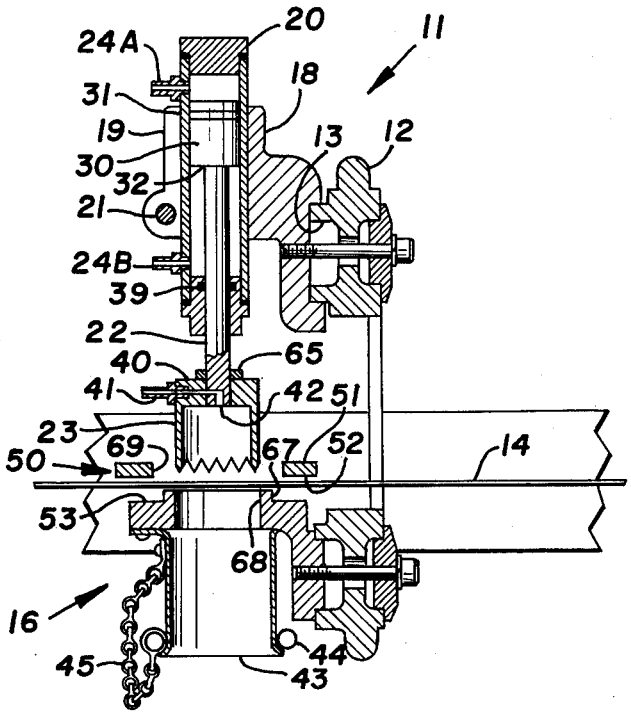
FIG. 2 is a vertical sectional view taken generally along the central axis of the punch illustrated in FIG. 1, this figure including a showing of the cooperating die immediately beneath the surface of the film.

With continued attention being directed to FIG. 2 of the drawings, it will be observed that the mounting or backing member of punch 23, such as at 40, is provided with a hose fitting or tubing receiving fitting 41, this fitting being adapted to receive a hose line carrying compressed air so as to deliver pulses of air for slug ejection as disclosed in detail in the aforementioned application of William S. Coombes, "PUNCH FOR FILM PRODUCTS HAVING IMPROVED SLUG REMOVAL FACILITY". Compressed gas accordingly enters bore 42 and is delivered outwardly into the interior confines of die engaging face of punch 23 at a point in time when punch 23 has severed a slug of film from the web 14, thereby ejecting the film slug from the core or interior of die engaging face 23. With continued attention being directed to FIG. 2, it will be observed that the ejected slug will be discharged through skirt member or the like 43 which functions as a bag holder for receipt of ejected slugs. Annular spring member 44 is retained on chain member 45 for the purpose of periodic removal of a bag, not shown, which hangs in distended relationship from skirt member 43, the inner periphery of which is captured between skirt member 43 and spring 44.

Figure 3:
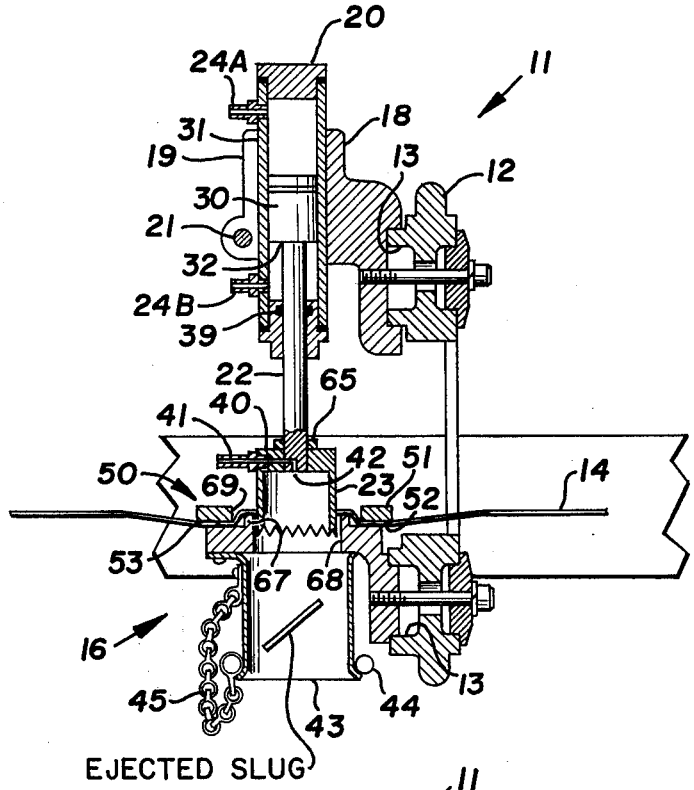
FIG. 3 is a view similar to FIG. 2, but illustrating the punch in its bottom dead-center disposition, and with the film clamping shoe means in engagement with the flexible film.

With continued attention being directed to FIGS. 1–3 inclusive of the drawings, it will be observed that film clamping means generally designated 50 is provided, the film clamping means including a film clamping shoe 51 having a lower film clamping surface 52 which cooperates with an upper film clamping surface 53 of die assembly 16 such as the upper surface of the die base. Film clamping assembly 50 is resiliently coupled and slidably secured to the reciprocating punch as is shown in FIG. 2. In this view, clamping shoe support bar or annular member 55 extends radially or laterally outwardly of punch 23, and is provided with a pair of support posts 56 and 57 which are secured at their lower ends to clamping shoe 51. A pair of threadedly engaged adjustment collars are provided at the upper end of members 56 and 57, as at 58 and 59, it being understood that collars 58 and 59 are arranged to control the normal disposition of clamping shoe 51, and likewise the extent of throw during each operational stroke of the punching member. Member 55 is secured to the punch member per se by means of screws such as is illustrated at 60 and 61.

In order to aid in lateral support and adjustment of the punching mechanism, a guide rod 62 may be employed, which is arranged to move relative to mounting head 18 through a bronze bushing 63. The lower end of guide rod 62 is coupled to the inner surface of the closed end of die engaging face 23 as at 64. Also, as is apparent in the drawings, jam nut 65 may be utilized to suitably retain punch member 23 in place at the terminal end of the ram 22.

Attention is now directed to the upper surface 53 of die 16, and particularly to the flanged projection 67 which extends outwardly from surface 53. This flange extends and circumscribes the bore 68 which is formed in the die assembly, with bore 68 making film cutting contact with punch 23 during an actual cutting operation. Flange 67 provides an annulus zone or space between the inner periphery of the opening formed in clamping shoe 51, as at 69, and the outer periphery of flange 67. The purpose of this annulus is to permit the film to be drawn smoothly but tautly about the member 67 for ultimate engagement or contact with punch 23. A combined spring force of several pounds is normally sufficient for the film clamping operation.

Figure 4:
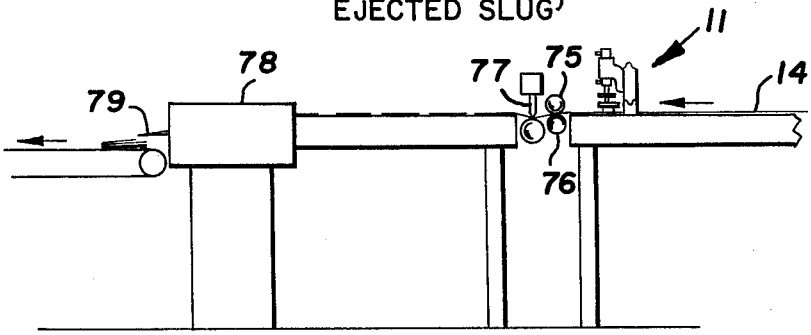
FIG. 4 is a side elevational view of a portion of a typical web handling system which includes the punches illustrated in FIGS. 1 and 2.

With continuing attention now being directed to FIGS. 2 and 3 and with attention also being directed to FIG. 4 of the drawings, it will be observed that the web of film 14 is engaged by the clamping shoe and retained tautly across the bore formed in the die. Upon advance of the punch 23 through the film and into the die area or zone, the taut film is severed cleanly and a blast of compressed air or other gaseous fluid passes through the bore 42 and thence into the punching head to eject the removed slug through skirt 43 and into a slug-receiving bag hanging from skirt 43. The punch mechanism of the present invention may be located or mounted in any desired location relative to the film web, wherein any portion of the web may be reached. The punch and associated die may be mounted in the system to achieve the desired punching pattern in the film being treated. Obviously, multiple punches may be provided in the machine direction as well as in the transverse direction, with the requirements being dictated by the overall finished product being prepared.

A typical installation is illustrated in FIG. 4 wherein the punching system 11 is being utilized to treat a moving web of film 14. The system is provided with draw rolls 75 and 76 along with a sealing bar as at 77. The operation is coordinated so that during dwell of the film 14, the punching operation as well as the sealing operation will occur. Following severing of a flexible film article from the web by the bar 77, or other cutting mechanism, a conveyor transports the finished article to a discharge area 78, the finished articles 79 being discharged, as indicated. This arrangement, as illustrated, is a typical side-weld product forming operation, and it will be appreciated, of course, that bottom-weld products may be fabricated, as well as other products having other configurations.

I claim as my invention:

1. In a punch assembly for perforation of flexible film products with cooperatively arranged punch and die assemblies, and comprising:

a. frame means for retaining a reciprocating punch and a stationary die;

b. a punch assembly including a punch member mounted on said frame means and including drive means for stroking said punch member in reciprocatory to-and-fro motion along a certain linear path of a first predetermined length and having upper and lower linear path limits;

c. a die assembly mounted on said frame means and including die and die base means with a punch-receiving bore formed therein and with said die and die base means having a film supporting upper pad surface circumscribing said die bore;

d. film clamping shoe means with a film clamping lower surface in opposed relationship to said film supporting upper pad surface and being slidably secured to said punch member with resilient coupling means and adapted to move with said punch member along the upper portion only of said linear path, said film clamping shoe means being secured to said punch member at an elevation normally spaced from said film supporting upper surface a second predetermined length which is less than said first predetermined length;

e. resilient means normally biasing said film clamping shoe toward said film supporting upper surface and arranging for compressive engagement of flexible film between said film supporting upper surface and said film clamping surface upon driving of said punch means toward said die a stroke length at least equal to said second predetermined distance; and f. flange means being disposed along said film supporting upper surface extending radially outwardly from the edge of said bore and in circumscribing relationship to said die bore, and wherein the upper edge surface of said flange is spaced upwardly from said film supporting upper surface and terminates radially inwardly of the inner edge surface of the film clamping lower surface of said clamping shoe.

2. The punch assembly as defined in claim 1 being particularly characterized in that said resilient means normally biasing said film clamping shoe is a resilient spring member.

3. The punch assembly as defined in claim 2 being particularly characterized in that a pair of resilient spring members are disposed in oppositely disposed relationship across said punch member.

4. The punch assembly as defined in claim 1 being particularly characterized in that said drive means is a fluid operated cylinder.

5. The punch assembly as defined in claim 4 being particularly characterized in that said drive means is a gaseous fluid operated cylinder.

6. The punch assembly as defined in claim 1 being particularly characterized in that means are provided for delivering a pulse of compressed air to said punch for ejecting film slugs from said punch member.

7. The punch assembly as defined in claim 1 being particularly characterized in that said film clamping surface is arranged in circumscribed relationship to said flange means, with the inner periphery of said film clamping surface being spaced outwardly from the outer surface of said flange means so as to define an annulus therebetween.

* * * * *

UNITED STATES PATENT OFFICE

CERTIFICATE OF CORRECTION

PATENT NO. : 3,992,966

DATED : November 23, 1976

INVENTOR(S) : Salvatore Patrick D'Agostino

It is certified that error appears in the above-identified patent and that said Letters Patent are hereby corrected as shown below:

Column 6, in Claim 7, at line 36, after the word "spaced" insert -- radially --.

Signed and Sealed this

Eighth Day of February 1977

[SEAL]

*Attest:*

RUTH C. MASON
*Attesting Officer*

C. MARSHALL DANN
*Commissioner of Patents and Trademarks*